US009401090B2

(12) United States Patent
Mochizuki

(10) Patent No.: US 9,401,090 B2
(45) Date of Patent: Jul. 26, 2016

(54) COLLISION AVOIDANCE SYSTEM FOR VEHICLES

(75) Inventor: Yutaka Mochizuki, Novi, MI (US)

(73) Assignee: Honda Motor Co., Ltd., Tokyo (JP)

( * ) Notice: Subject to any disclaimer, the term of this patent is extended or adjusted under 35 U.S.C. 154(b) by 1464 days.

(21) Appl. No.: 12/501,147

(22) Filed: Jul. 10, 2009

(65) Prior Publication Data

US 2010/0010742 A1 Jan. 14, 2010

Related U.S. Application Data

(60) Provisional application No. 61/080,137, filed on Jul. 11, 2008.

(51) Int. Cl.
*G08G 1/16* (2006.01)

(52) U.S. Cl.
CPC ..... *G08G 1/161* (2013.01)

(58) Field of Classification Search
CPC ..... G08G 1/16; G08G 1/161; G08G 1/162; G08G 1/163
USPC ..... 701/45, 117, 300–301, 400, 470; 340/901–903, 435–436
See application file for complete search history.

(56) References Cited

U.S. PATENT DOCUMENTS

| | | | | |
|---|---|---|---|---|
| 3,750,169 | A | 7/1973 | Strenglein | |
| 4,030,088 | A | 6/1977 | McCullough | |
| 4,107,674 | A | 8/1978 | Funatsu et al. | |
| 5,189,426 | A | 2/1993 | Asbury et al. | |
| 5,337,046 | A * | 8/1994 | Grasset | 340/944 |
| 5,467,072 | A | 11/1995 | Michael | |
| 5,652,705 | A | 7/1997 | Spiess | |
| 6,011,492 | A * | 1/2000 | Garesche | 340/904 |
| 6,370,475 | B1 | 4/2002 | Breed et al. | |
| 6,720,920 | B2 | 4/2004 | Breed et al. | |
| 6,813,561 | B2 * | 11/2004 | MacNeille et al. | 701/470 |
| 6,985,089 | B2 * | 1/2006 | Liu et al. | 340/903 |
| 7,133,768 | B2 * | 11/2006 | Mukaiyama | 701/400 |
| 7,190,260 | B2 | 3/2007 | Rast | |
| 7,315,239 | B2 * | 1/2008 | Cheng et al. | 340/436 |
| 7,330,103 | B2 | 2/2008 | Boss et al. | |
| 7,355,525 | B2 * | 4/2008 | Tengler et al. | 340/905 |

(Continued)

FOREIGN PATENT DOCUMENTS

| | | | |
|---|---|---|---|
| JP | 2008225897 A * | 9/2008 | |
| WO | WO 2008119763 A1 * | 10/2008 | H01Q 1/32 |

OTHER PUBLICATIONS

International Search Report and Written Opinion mailed Jan. 11, 2010, from PCT Application No. PCT/US2009/050326.

(Continued)

*Primary Examiner* — John Q Nguyen
*Assistant Examiner* — Michael Whalen
(74) *Attorney, Agent, or Firm* — Arent Fox LLP

(57) ABSTRACT

A collision avoidance system uses map information to manage power. The collision avoidance system operates at a first communications range when a vehicle is determined, based upon the map information, to be in a relatively low collision risk scenario. When the collision avoidance system determines that the vehicle is approaching a situation of increased collision risk, such as an intersection, the communications is increased. The communications range may be increased by increasing the power to the antenna system or using antenna diversity techniques.

11 Claims, 7 Drawing Sheets

(56) References Cited

U.S. PATENT DOCUMENTS

| | | | | |
|---|---|---|---|---|
| 7,433,773 | B2 * | 10/2008 | Tengler et al. | 701/100 |
| 7,804,423 | B2 * | 9/2010 | Mudalige et al. | 340/902 |
| 2003/0120826 | A1 * | 6/2003 | Shay | 709/316 |
| 2004/0193347 | A1 * | 9/2004 | Harumoto et al. | 701/45 |
| 2005/0168350 | A1 * | 8/2005 | Tauchi | 340/903 |
| 2006/0077111 | A1 * | 4/2006 | Kushida | 343/713 |
| 2007/0005609 | A1 | 1/2007 | Breed | |
| 2007/0021915 | A1 * | 1/2007 | Breed et al. | 701/301 |
| 2007/0106431 | A1 * | 5/2007 | Tsuzuki et al. | 701/1 |
| 2007/0146162 | A1 | 6/2007 | Tengler et al. | |
| 2007/0164896 | A1 * | 7/2007 | Suzuki et al. | 342/70 |
| 2008/0036579 | A1 | 2/2008 | Boss et al. | |
| 2008/0288162 | A1 * | 11/2008 | Theimer et al. | 701/117 |
| 2011/0009151 | A1 * | 1/2011 | Miucic | 455/522 |
| 2011/0260846 | A1 * | 10/2011 | Mochizuki et al. | 340/435 |

OTHER PUBLICATIONS

International Preliminary Report on Patentability (including Written Opinion of the ISA) mailed Jan. 20, 2011 in International Application No. PCT/US2009/050326.

Daniel Jiang et al: "Design of 5.9 ghz dsrc-based vehicular safety communication", IEEE Wireless Communications, IEEE Service Center, Piscataway, NJ,US, vol. 13, No. 5, Oct. 1, 2006, pp. 36-43, XP011143982, ISSN: 1536-1284.

European Search Report in European Patent Application No. 09795268 dated Aug. 10, 2011.

* cited by examiner

COLLISION AVOIDANCE SYSTEM FOR VEHICLES

CROSS-REFERENCE TO RELATED APPLICATION

This application claims priority under 35 U.S.C. §119(e) to U.S. Provisional Patent Application No. 61/080,137, entitled "Collision Avoidance System for Vehicles", and filed on Jul. 11, 2008, which application is hereby incorporated by reference.

BACKGROUND

The present invention relates generally to collision avoidance systems and more particularly to a power management scheme for dedicated short range communications collision avoidance systems.

In recent years, safety systems have been developed to assist drivers in avoiding impending accidents, such as collision avoidance and warning systems. These systems may employ direct vehicle-to-vehicle communications or use roadside-based networks to assist or control the vehicle communications.

For example, U.S. Pat. No. 7,315,239 discloses a collision avoidance system. A subject vehicle is provided with forward and rear-ward looking radar systems to determine the speed and relative distances of surrounding vehicles, such as vehicles in front of and behind the vehicle. If a surrounding vehicle comes too close to the vehicle employing the collision avoidance system, the collision avoidance system alerts the driver of the subject vehicle. Additionally, if the surrounding vehicles utilize a similar collision avoidance system, the collision avoidance systems can communicate with each other so that multiple vehicle drivers are simultaneously warned of an unsafe condition.

Intersections are areas of increased collision risk. A collision avoidance system for use at intersections is disclosed in U.S. Pat. No. 7,209,051. A system is deployed at an intersection to assist vehicles in or approaching the intersection. The system utilizes a number of sensors positioned around the intersection. A vehicle sensor monitors vehicles approaching the intersection. An entering vehicle sensor detects a vehicle waiting to enter the intersection, such as by pulling into a gap in the oncoming traffic. The information provided by the vehicle sensor is used to estimate the length of the gap in the oncoming traffic. The system can then inform the waiting vehicle driver when the gap is sufficiently large for safe entry into the intersection.

In the U.S., the dedicated short range communications (DSRC) protocol for vehicle-to-infrastructure and vehicle-to-vehicle communication is becoming a standard technology. DSRC can be used in many applications, including automatic toll collection, traffic management systems, and collision avoidance systems. DSRC systems can transmit vehicle safety messages which account for factors such as vehicle speed, heading, location, and the like and consume up to two (2) watts of power for a transmission according to the United States Federal Communications Commission (FCC) regulations. This large transmission power enables a wide range of communication for the vehicle system. However, the wide range of communication performance also requires stronger computing power (by the on-board computers) to track all of the detected vehicles. Such power consumption is not needed at all times, but current systems do not employ power management strategies. In particular, the collision avoidance system could be operated at less than full power under normal conditions and at full power only when in or approaching a increased-risk location. One such increased collision risk location exists at intersections.

Therefore, there exists a need in the art for a collision avoidance system that manages transmission power based upon a detected collision risk scenario.

SUMMARY

A system and method for collision avoidance in vehicles is provided. The system generally includes individual collision avoidance systems in each vehicle, and, optionally, roadside equipment. The collision avoidance systems and roadside equipment are configured to communicate with each other. Additionally, the collision avoidance systems may be linked to navigational systems to take advantage of navigational information.

During normal operation, the collision avoidance systems are operated so that the communications range of the system is less than the maximum achievable communications range. However, in increased collision risk locations, such as when proximate an area controlled by a traffic control device, communications rage of the system is increased.

This increase in the communications range may be achieved by increasing the power to the collision avoidance system, such as by operating at or near full power. This power boost to the collision avoidance system allows signals transmitted by the collision avoidance systems to reflect and diffract off of obstructions to be able to reach surrounding vehicles. This increases the likelihood that the collision avoidance systems will detect the surrounding vehicles and warn a driver of a possible imminent collision.

In another aspect, the change in the communications range of the system is achieved by controlling the operation of an antenna array. The standard communications range may be achieved by operating only one antenna in the array. The long communications range may be achieved by employing antenna diversity techniques. These techniques may be used to select an antenna with better performance or to combine the operation of multiple antennas to increase received signal quality and/or strength.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

One safety feature that may be provided with a motor vehicle may include a collision avoidance system or CAS. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to cars, trucks, vans, minivans, SUVs, motorcycles, scooters, boats, personal watercraft, and aircraft.

Collision avoidance systems may utilize a number of different technologies. Some CASs use radar-based systems to detect surrounding vehicles and to determine the potential for a collision. Other CASs may utilize dedicated short range communications (DSRC). DSRC is a short to medium range communications service that provides communications links with high data transfer rates with minimal latency. Motor vehicles equipped with DSRC systems may communicate with each other or with road side equipment (RSE) configured to communicate with the motor vehicle DSRC systems as the motor vehicles pass within the range of the of the RSE. The range of DSRC is typically about 300 meters, with systems having a maximum range of about 1000 meters. DSRC in the U.S. operates in the 5.9 GHz range, from about 5.85 GHz to about 5.925 GHz.

Many motor vehicle systems already employ DSRC, such as for automatic toll collection. DSRC standards in the U.S. include a provision for a dedicated channel for vehicle safety, currently channel 172. Collision avoidance systems may operate on this dedicated channel.

Figure 1:
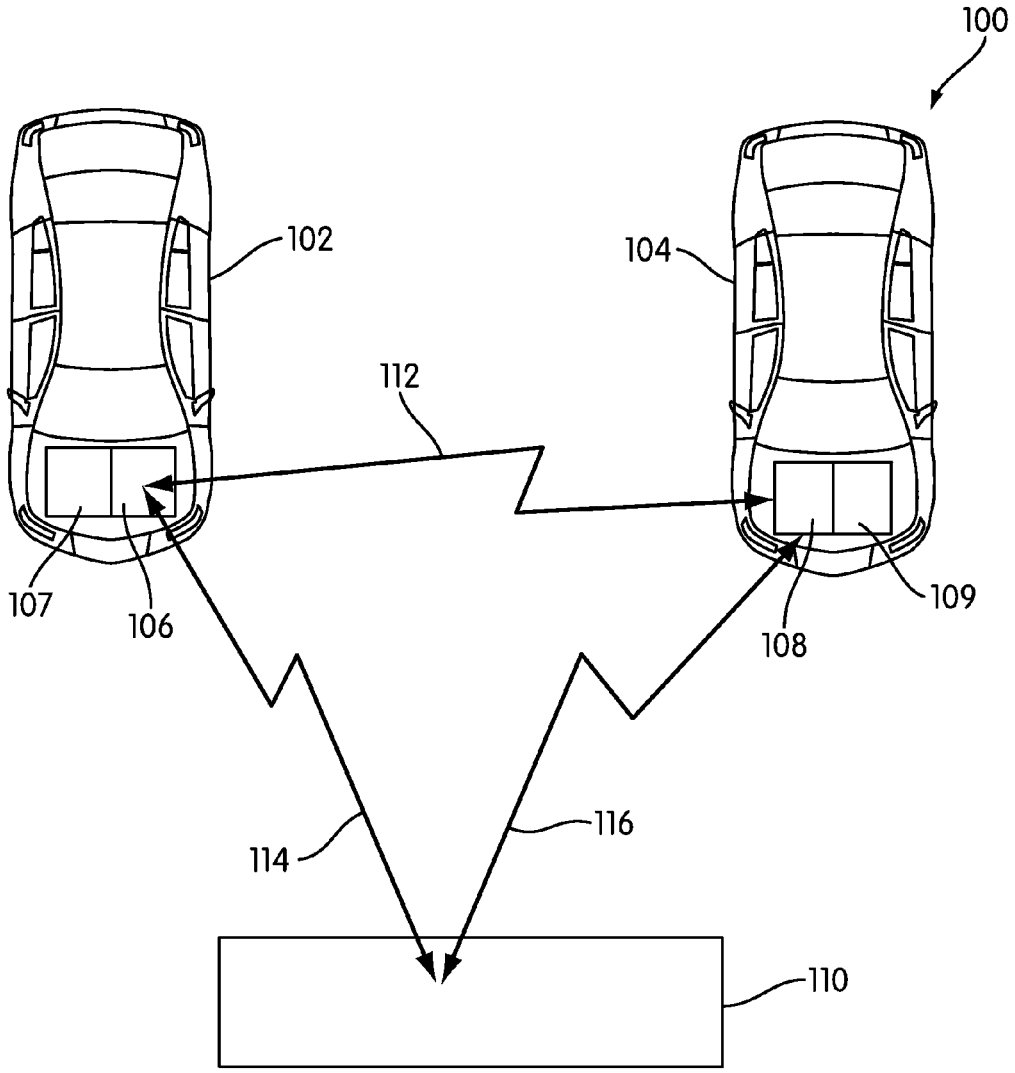
FIG. 1 is a schematic drawing of an embodiment of a DSRC-based collision avoidance system.

FIG. 1 is a schematic diagram of an embodiment of a collision avoidance system 100 according to the invention. In the embodiment shown in the drawing, a first vehicle 102 is equipped with a first CAS 106. Similarly, a second vehicle 104 is equipped with a second CAS 108. Although shown as cars, first vehicle 102 and second vehicle 104 may be any type of vehicle known in the art.

In addition to CAS systems, first vehicle 102 may be provided with a first navigational system 107. Similarly, second vehicle 104 may be provided with a second navigational system 108. Navigational systems 107 and 109 may be any type of navigational systems known in the art, such as the navigational system disclosed in U.S. Pat. No. 7,184,888, the entirety of which is incorporated herein by reference. Navigational systems 107 and 109 in some embodiments include GPS information to determine the location of the vehicles, map information provided to navigational systems 107 and 109, and a display for communicating navigational information to the driver of the vehicle. Navigational systems 107 and 109 may be in communication with CASs 106 and 108, respectively, so that navigational information may be shared with CASs 106 and 108 for use in collision detection. The term "navigation information" refers to any information that can be used to assist in determining a location or providing directions to a location. Some examples of navigation information include street addresses, street names, street or address numbers, apartment or suite numbers, intersection information, traffic control devices, points of interest, parks, any political or geographical subdivision including town, township, province, prefecture, city, state, district, ZIP or postal code, and country. Navigation information can also include commercial information including business and restaurant names, commercial districts, shopping centers, and parking facilities. Navigation information can also include geographical information, including information obtained from any Global Navigational Satellite infrastructure (GNSS), including Global Positioning System or Satellite (GPS), Glonass (Russian) and/or Galileo (European). The term "GPS" is used to denote any global navigational satellite system. Navigation information can include one item of information, as well as a combination of several items of information.

First CAS 106 and second CAS 108 may be any type of CAS known in the art. Generally, CASs 106 and 108 include a transmitter, a receiver (which may be combined into a single transceiver), and a controller, such as a processor with memory. In one embodiment, first CAS 106 and second CAS 108 are configured to include DSRC transceivers. First CAS 106 and second CAS 108 may include one or more channels that operate on a standard frequency provided to DSRC vehicular communications. For example, in the United States, DSRC standards operate between about 5.85 GHz and 5.925 GHz. In other embodiments, the transceivers of CASs 106 and 108 may operate on other frequencies.

Each transceiver 106 and 108 may be configured to send and receive data transmissions. For the purposes of this application "data" may include audio, visual, and/or information. For example, transceivers 106 and 108 may transmit any or all of a tone that may be recognized as the presence of a vehicle, the output of forward-looking cameras so that other vehicles can see what the driver of the transmitting vehicle sees, vehicle identification information, vehicle vectors and operating speeds, or the like. The operating baud rate of DSRC systems tends to be between about 6 Mbps to about 27 Mbps, so significant amounts of data may be transmitted on a DSRC system.

First transceiver 106 and second transceiver 108 may be configured to communicate directly with each other via vehicle-to-vehicle communications link 112. Vehicle-to-vehicle communications link 112 may be any type of communications signal known in the art, such as a radio frequency wave, an optical signal, or the like. Vehicle-to-vehicle communications link 112 may include security protocols, such as encryption and/or origination verification.

Vehicle-to-vehicle communications link 112 may be established when first vehicle 102 and second vehicle 104 come into the communication range of transceivers 106 and 108. For example, first transceiver 106 may emit a periodic signal searching for a response. When second transceiver 108 comes into range, second transceiver 108 may detect the periodic message transmitted by first transceiver 106 and establish communications link 112. Alternatively, second transceiver 108 may emit a recognition signal so that first transceiver 106 may establish vehicle-to-vehicle communications link 112. As will be apparent to those in the art, second transceiver 108 may also be transmitting a periodic signal, with first transceiver 106 detecting the signal.

In some embodiments, the DSRC may be provided with a network of roadside equipment (RSE) such as RSE 110. RSE 110 may be any type of RSE known in the art, such as a transceiver positioned on a building, tower, or other roadside object. RSE 110 may be configured to communicate with vehicles within the communications range of the communication capabilities of RSE 110. For example, RSE 110 may communicate with first vehicle 102 via a first system communications link 114 and with second vehicle 104 via a second system communications link 116. System communications links 114 and 116 may have one or both of uplink and downlink capabilities. System communications links 114 and 116 may be any type of communications signal known in the art, such as radio frequency or optical signals. System communications link 114 and 116 may include security protocols, such as encryption and/or origination verification.

A network of similar RSEs may be positioned, such as at intervals along a highway. Each RSE may be provided with a controller, such as a processor with memory configured to determine, for example, if a vehicle is permitted to communicate with the RSE, if a communications link can or should be established, and on what channel to transmit information. Each RSE may continuously search for vehicles, such as by transmitting a periodic signal and searching for a reply so that a communications link may be established. Similarly, the vehicles may transmit periodic signals and search for replies from an in-range RSE. If an RSE replies, then a communications link may be established.

Typically, the maximum range for communications in a DSRC system is about 300 m. In practice, the communications range may be shortened to reduce channel congestion. Typical power requirements for DSRC systems are about 2 watts for both uplink and downlink, with lower power requirements for shorter communications ranges. Therefore, CASs 106 and 108 may be operated to achieve a standard communications range, a range lower than the maximum achievable communications range, and a long communications range, a range that is higher than the standard communications range. The CAS may operate at the standard communications range under normal operating conditions to conserve power and to reduce channel congestion. In certain scenarios, however, the long communications range may be desirable, such as when the vehicle is operating proximate an increase collision risk location, such as proximate an area with a traffic control device.

In some embodiments, the standard communications range is achieved by operating the CAS at a first power level or low power during normal driving conditions. For the purposes of this application, "low power" may be considered to be less than full power. Low power may, in some embodiments, range from about 50% of full power to about 80% of full power. However, when the long communications range is desirable, it may be advantageous to operate at a second power level that is higher than low power, which includes full power. For the purposes of this application, "full power" may include actual full power and a power level slightly less than actual full power. In some embodiments, antenna arrays are provided in the CAS. The standard communications range may be achieved with a single antenna from the array, and antenna diversity techniques may be employed to increase the communications range to the long communications range. Other techniques known in the art may also be used to increase antenna sensitivity, to boost transmitted and/or received signal strength, to increase the computer analysis of a signal, or to otherwise increase the communications range of the CAS under certain conditions, such as when the vehicle is approaching or in operating in an increased collision risk location.

Figure 2:
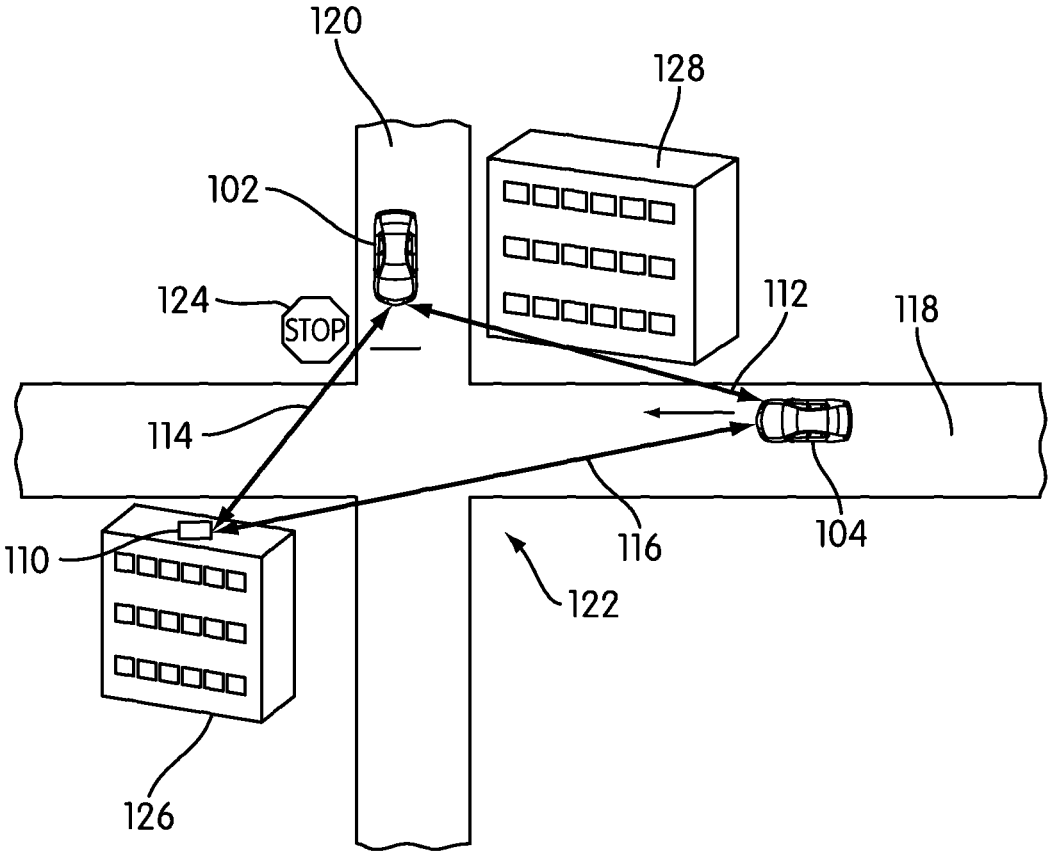
FIG. 2 is a schematic drawing showing an embodiment of a DSRC-based collision avoidance system in an intersection scenario.

One such increased collision risk location is shown in FIG. 2. First vehicle 102 is traveling on a first roadway 120, and second vehicle 104 is traveling on a second roadway 118. First roadway 120 meets second roadway 118 at an intersection 122. One or both of vehicles 102 and 104 may encounter a traffic control device 124. Traffic control device 124 may be any type of traffic flow control sign or structure known in the art, such as a light, sign, circle, or even a stationed traffic control law enforcement individual.

The view from first roadway 120 to second roadway 118, and vice versa, may be at least partially obstructed by one or more structures, such as first building 126 and second building 128. Therefore, as vehicles 102 and 104 approach intersection 122, at least one of vehicles 102 and 104 may not be able to see the other vehicle. This increases the risk of a collision. Ideally, as shown in FIG. 2, first and second CASs are able to establish vehicle-to-vehicle communications link 112 or system communications link 114, 116. However, establishing communications links may be difficult if the CAS is operating at low power, such as if obstructions block or scatter the transmitted signals.

Figure 3:
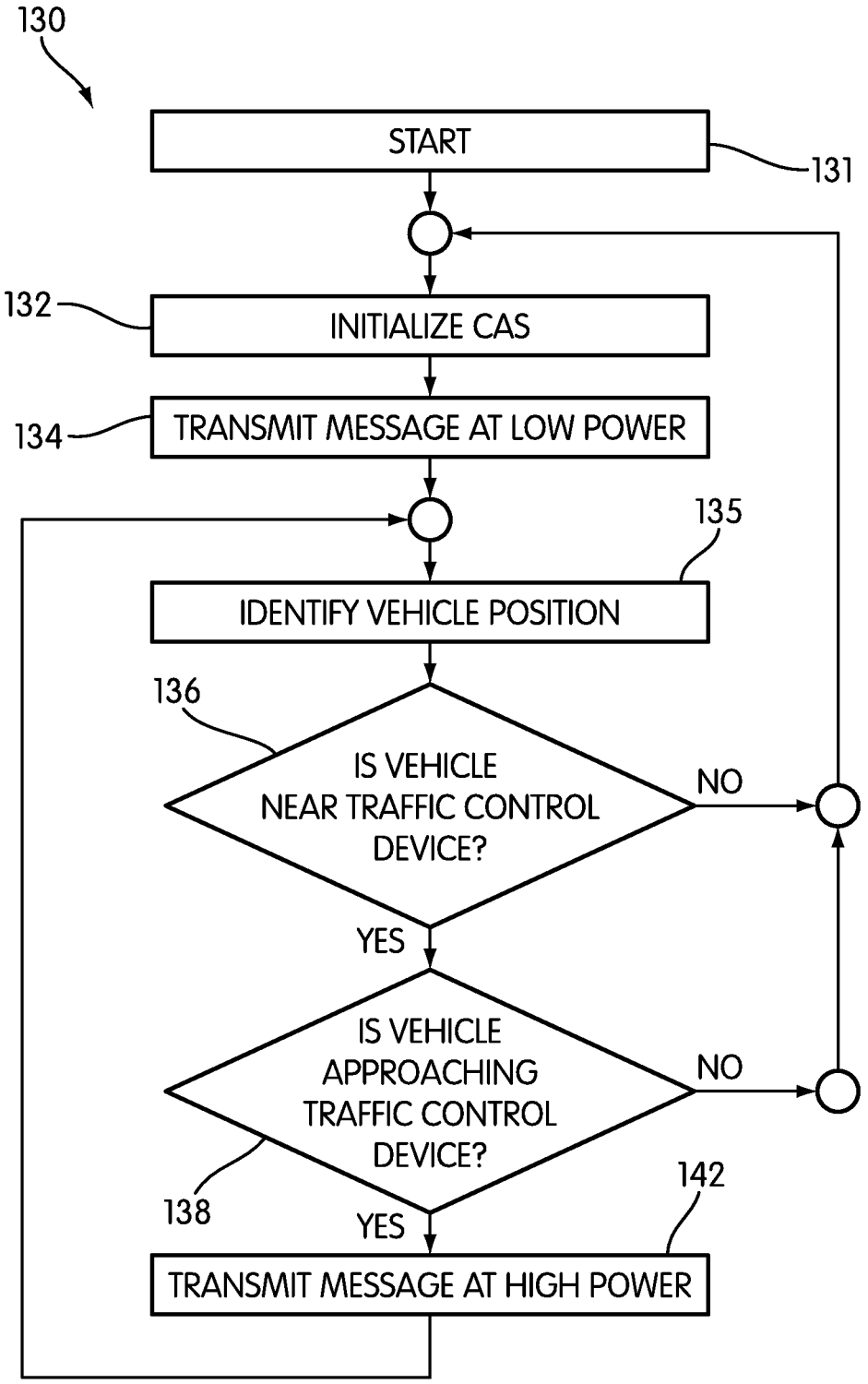
FIG. 3 is a flowchart showing the steps in an embodiment of a collision avoidance system power management procedure.

FIG. 3 shows a power management procedure 130 that accounts for increased-risk collision scenarios that incorporate traffic signals. Generally, the CAS is directed to operate at low power during normal driving conditions, detect the approach to a traffic control device, and boost the operating power to the CAS to full power when the vehicle is proximate the traffic control device.

Starting at step 131, the CAS may be in a sleep mode, powered down, or otherwise not initialized. In step 132, the CAS is initialized. The CAS may be initialized upon starting the vehicle, such as by turning a key in an ignition, or the CAS may be initialized when the driver instructs the system to turn on, such as by pressing a button, using a voice command, or the like. The CAS is supplied power by the vehicle and begins to transmit a periodic signal searching for a response and/or listens to detect a signal from another vehicle. In step 134, the CAS operates at low power.

At step 135, the CAS identifies the vehicle position. This can be achieved, for example, by communicating with the vehicle's navigation system, GPS system, or the like. At step 136, the controller of the CAS periodically queries whether or not the vehicle is positioned near a traffic control device in order to determine whether or not the power to the CAS should be increased. The vehicle position may be determined in conjunction with the navigation system of the vehicle which may plot the vehicle position on a map. If the map contains traffic control device information, the CAS may determine proximity to the traffic control device using the navigation information. Also, the CAS may be linked to sensors on the vehicle that can determine if the vehicle is approaching a traffic control device, such as cameras and visual analysis software to analyze the images captured by the cameras. If the vehicle is not approaching a traffic control device, then the CAS continues to operate at low power. If the vehicle is approaching a traffic control device, then the controller may move to step 138. In some embodiments, the controller may not utilize step 136, but the controller may simply assume that the vehicle is approaching an intersection or other increased risk collision location if navigation information indicates the presence of a traffic signal.

At step 138, the controller of the CAS may determine whether or not the vehicle is approaching the traffic control device. This information may be obtained from the navigational system, as many navigational system maps now include traffic signal information. The controller may be linked with the vehicle's on board unit or computer to assist the estimation, which may indicate that the vehicle is approaching an intersection. If the vehicle is not approaching a traffic control device, then the controller returns to step 134 to operate the CAS at low power. If the vehicle is approaching a traffic signal, then the controller moves to step 142. In other embodiments, step 138 may include the use of navigation information to determine if the vehicle is approaching any increased collision risk location, and not just locations that include traffic control devices.

In step 142, the controller increases the power to the CAS to full power and transmits messages/communications at full power. In some embodiments, the power increase may be a percentage as opposed to increasing the power to the maximum available to the CAS. For example, if the CAS is operating at 50% of full power in the normal low power operating stage, then the power boost may be 25% to 75% of full power. The power increase may be tailored to determine if other systems are drawing power so that no system is dimmed or burned out by the power increase to the CAS. After the power boost or increase, the controller operates the CAS as the full power or higher power level.

Periodically, the controller moves back to step 135 to query whether or not the vehicle has passed through the traffic control device, i.e., cleared a controlled intersection. At step 136 and 138, if the vehicle passed through the control device, the controller moves back to step 134 and CAS continues to operate at lower power. The controller then cycles again until the CAS is shut down, such as by turning off the vehicle or by instructing the CAS to shut down.

After returning to step 134 and 135, the CAS continues to operate at low power. The controller then cycles through procedure 130 again until the CAS is shut down, such as by turning off the vehicle or by instructing the CAS to shut down.

Figure 4:
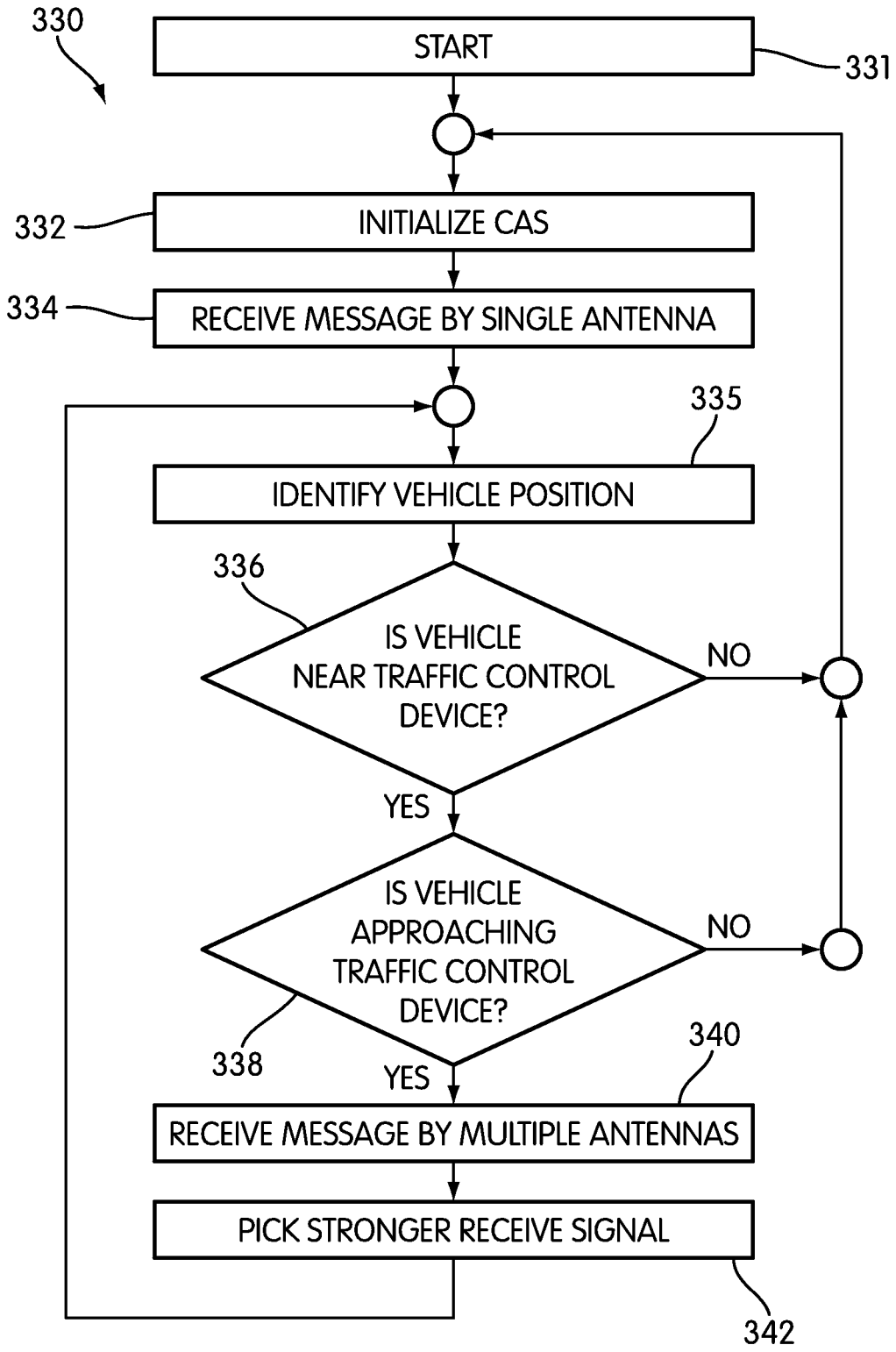
FIG. 4 is a flowchart showing the steps in another embodiment of a collision avoidance system power management procedure using antenna diversity technology.

FIG. 4 shows another embodiment of a power management procedure that may be used by the CAS, where antenna diversity technology is used to manage the power. These antenna diversity techniques may be used alone or in conjunction with the other power management techniques described above, such as those described with respect to FIG. 3.

Antenna diversity is an antenna management technique where a system has multiple antennas but may only selectively utilize the antennas. For example, a single antenna may be used under certain conditions while multiple antennas may be used other conditions. These conditions may include detected signal quality, detected signal strength, timing, detected proximity to transmitters, user preference, or the like. The antenna usage may be controlled using a number of different techniques.

In multiple antenna arrays, the antenna array may be managed using the "switching" technique, where the signal from only one antenna is fed to the receiver as long as the quality of the signal from that antenna remains above a predetermined threshold. If the signal degrades, then another antenna is activated, i.e., switched on. Switching is a simple and low power consuming technique. However, the received signal may suffer from periods of fading and desynchronization when the quality of the in-use antenna deteriorates and a new antenna is being activated.

Another antenna management technique is "selecting". In selecting, only one antenna's signal is sent to the receiver at any one point in time. The antenna is selected based upon the detected signal-to-noise ratio (SNR) of all of the antennas. This method, therefore, needs a period of time to measure the SNR of all of the antennas, which all must have established connections with the receiver during the SNR measurement period. This increases the power consumption requirements over switching. However, the antenna selection may occur quickly, such as between receipt of packets of data. Switching between antennas can therefore occur on a packet-by-packet basis, allowing for a very high quality receipt of data.

Another technique for antenna management is "combining". This technique has all of the available antennas maintaining established connections at all times. The signals are then combined and presented to the receiver. The signals may be added directly (equal-gain combined) or weighted and added coherently (maximal ratio combined). This type of antenna management is highly resistant to signal fade, but consumes the most power.

Another technique for antenna management is "dynamic control", where the receivers can choose the antenna management scheme (switching, selecting, or combining) based upon detected conditions. While dynamic control utilizes more computation power than the other antenna management techniques, a dynamically controlled system may optimize power versus performance of the antenna array on the fly. In situations where the signal is good or high signal performance is not required, a single antenna may be used. When conditions change, one switching, selecting, or combining techniques may be used to increase the signal quality or strength.

In antenna diversity procedure 330, shown in FIG. 4, the CAS operates similarly to procedure 130 shown in FIG. 3. Starting at step 331, the CAS may be in a sleep mode, powered down, or otherwise not initialized. In step 332, the CAS is initialized. In step 334, the CAS operates with no antenna diversity, i.e., any messages are received by a single antenna. The use of only one antenna out of an array reduces the power consumption of the system.

At step 335, the CAS identifies the vehicle position. This can be achieved, for example, by communicating with the vehicle's navigation system, GPS system, or the like. At step 336, the controller of the CAS periodically queries whether or not the vehicle is positioned near a traffic control device in order to determine whether or not antenna diversity should be used. Any of the methods described above with respect to step 136 of procedure 130 shown in FIG. 3 may be used to determine whether or not the vehicle is proximate a traffic control device in step 336 of antenna diversity procedure 330.

At step 338, the controller of the CAS may determine whether or not the vehicle is approaching the traffic control device, similarly to how the CAS determines whether or not the vehicle is approaching the traffic control device in step 138 of procedure 130 shown in FIG. 3. If the vehicle is not approaching a traffic control device, then the controller returns to step 334 to receive messages with only one antenna. If the vehicle is approaching a traffic signal, then the controller moves to step 340.

In step 340, one of the antenna diversity techniques is used to allow the CAS to receive messages/communications by multiple antennas. Any one of switching, selecting, combining, dynamic control, or combinations of these techniques may be used to permit the use of multiple antennas.

In step 342, the controller may select a stronger received signal for the receipt of messages. After evaluating all of the received signals in step 340, one antenna may be outperforming the other antennas in terms of signal strength and/or quality. This antenna may be chosen to receive the signal in the vicinity of the traffic control device. In other embodiments, multiple antennas are chosen to provide the CAS with a combined or overall signal having the desired strength or quality that is greater than the signal strength or quality that is available form the single antenna used in step 334 to receive messages.

Periodically, the controller moves to step 355, 336 and 338 to query whether or not the vehicle has passed through the traffic control device, i.e., cleared a controlled intersection. If the vehicle has not passed through the traffic control device, then the controller continues to utilize antenna diversity techniques to receive stronger signals than would be available from a single antenna. If the vehicle has passed through the traffic control device, then the controller may assume that the vehicle is exiting the increased collision risk location and returns to single antenna signal receipt (step 334, no antenna diversity) while monitoring the vehicle position (step 335).

After returning to step 334, the CAS continues to operate with only one antenna. The controller then cycles through antenna diversity procedure 330 again, changing to multiple antennas as determined by antenna diversity procedure 330, until the CAS is shut down, such as by turning off the vehicle or by instructing the CAS to shut down.

Figure 5:
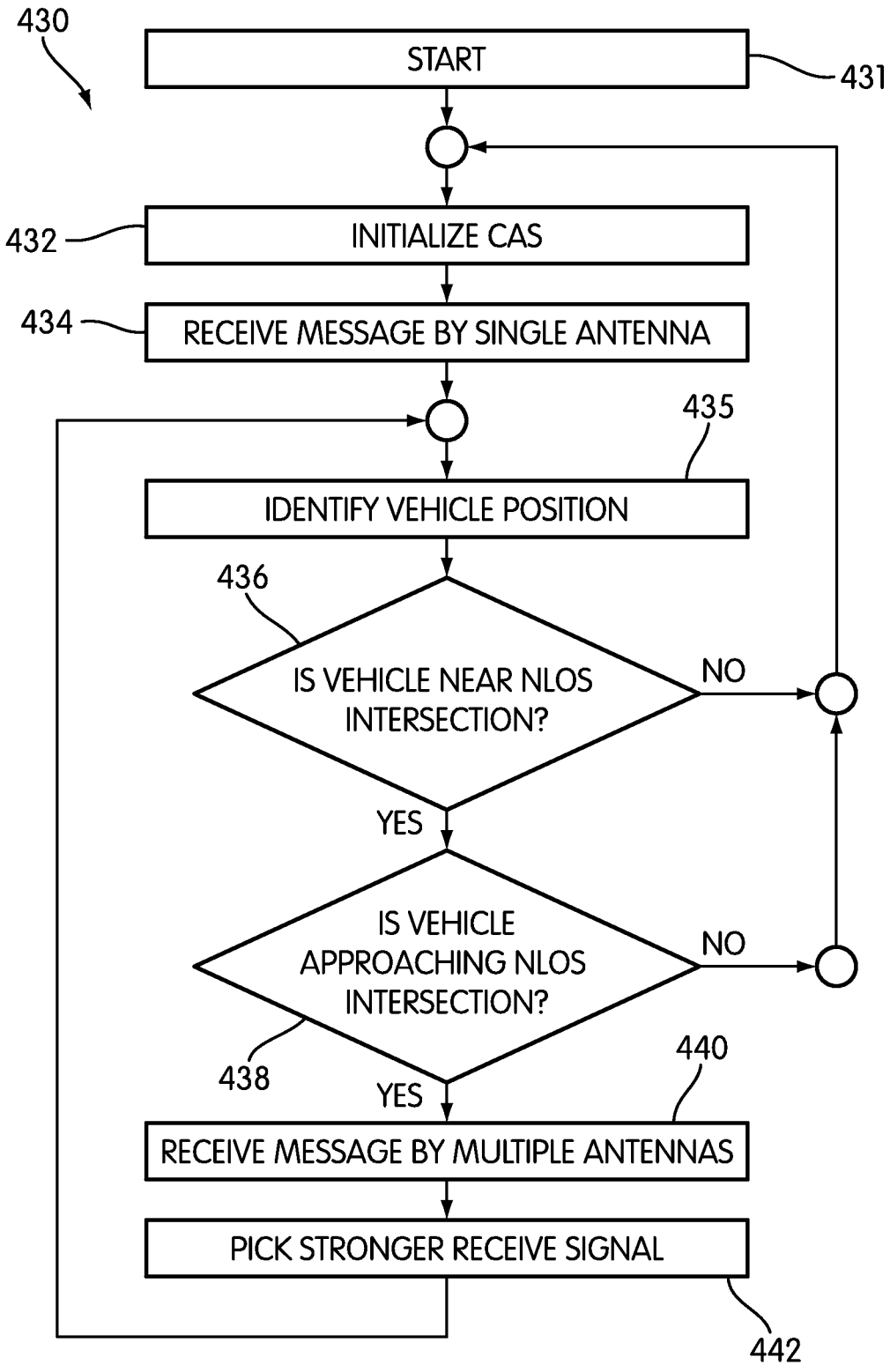
FIG. 5 is a flowchart showing the steps in another embodiment of a collision avoidance system power management procedure in a blind intersection.

Another antenna diversity procedure 430, shown in FIG. 5, may be used when the increased collision risk location is a non-line of sight (NLOS) situation, i.e., a blind intersection. In second antenna diversity procedure 430, the CAS operates similarly to procedure 330 shown in FIG. 4. Starting at step 431, the CAS may be in a sleep mode, powered down, or otherwise not initialized. In step 432, the CAS is initialized. In step 434, the CAS operates with no antenna diversity, i.e., any messages are received by a single antenna. The use of only one antenna out of an array reduces the power consumption of the system.

At step 435, the CAS identifies the vehicle position. This can be achieved, for example, by communicating with the vehicle's navigation system, GPS system, or the like. At step 336, the controller of the CAS periodically queries whether or not the vehicle is positioned near an NLOS intersection in order to determine whether or not antenna diversity should be used. Any of the methods described above with respect to step 136 of procedure 130 shown in FIG. 3 may be used to determine whether or not the vehicle is proximate an NLOS intersection in step 436 of antenna diversity procedure 430.

At step 438, the controller of the CAS may determine whether or not the vehicle is approaching the traffic control device, similarly to how the CAS determines whether or not the vehicle is approaching the traffic control device in step 338 of procedure 330 shown in FIG. 4. If the vehicle is not approaching an NLOS intersection, then the controller returns to step 434 to receive messages with only one antenna. If the vehicle is approaching an NLOS intersection, then the controller moves to step 440.

In step 440, one of the antenna diversity techniques is used to allow the CAS to receive messages/communications by multiple antennas. Any one of switching, selecting, combining, dynamic control, or combinations of these techniques may be used to permit the use of multiple antennas.

In step 442, the controller may select a stronger received signal for the receipt of messages. After evaluating all of the received signals in step 440, one antenna may be out-performing the other antennas in terms of signal strength and/or quality. This antenna may be chosen to receive the signal in the vicinity of the traffic control device. In other embodiments, multiple antennas are chosen to provide the CAS with a combined or overall signal having the desired strength or quality that is greater than the signal strength or quality that is available form the single antenna used in step 434 to receive messages.

Periodically, the controller moves to step 436 to query whether or not the vehicle has passed through the NLOS intersection. If the vehicle has not passed through the NLOS intersection, then the controller continues to utilize antenna diversity techniques to receive stronger signals than would be available from a single antenna. If the vehicle has passed through the NLOS intersection, then the controller may assume that the vehicle is exiting the increased collision risk location and returns to single antenna signal receipt (step 434, no antenna diversity) while monitoring the vehicle position (step 435).

[After returning to step 434 and step 435, the CAS continues to operate with only one antenna. The controller then cycles through second antenna diversity procedure 430 again, changing to multiple antennas as determined by antenna diversity procedure 430, until the CAS is shut down.

Figure 6:
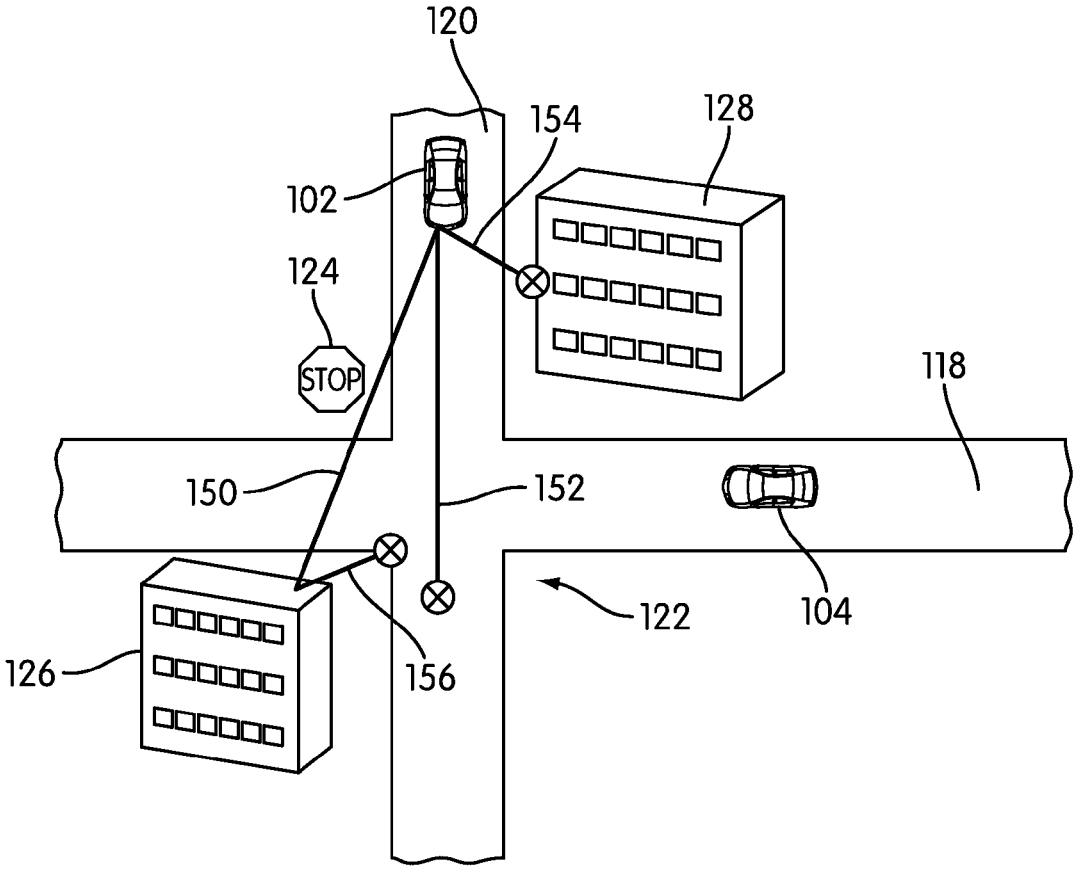
FIG. 6 is a schematic drawing showing an embodiment of a DSRC-based collision avoidance system operating at low power when approaching an intersection employing a traffic signal.
Figure 7:
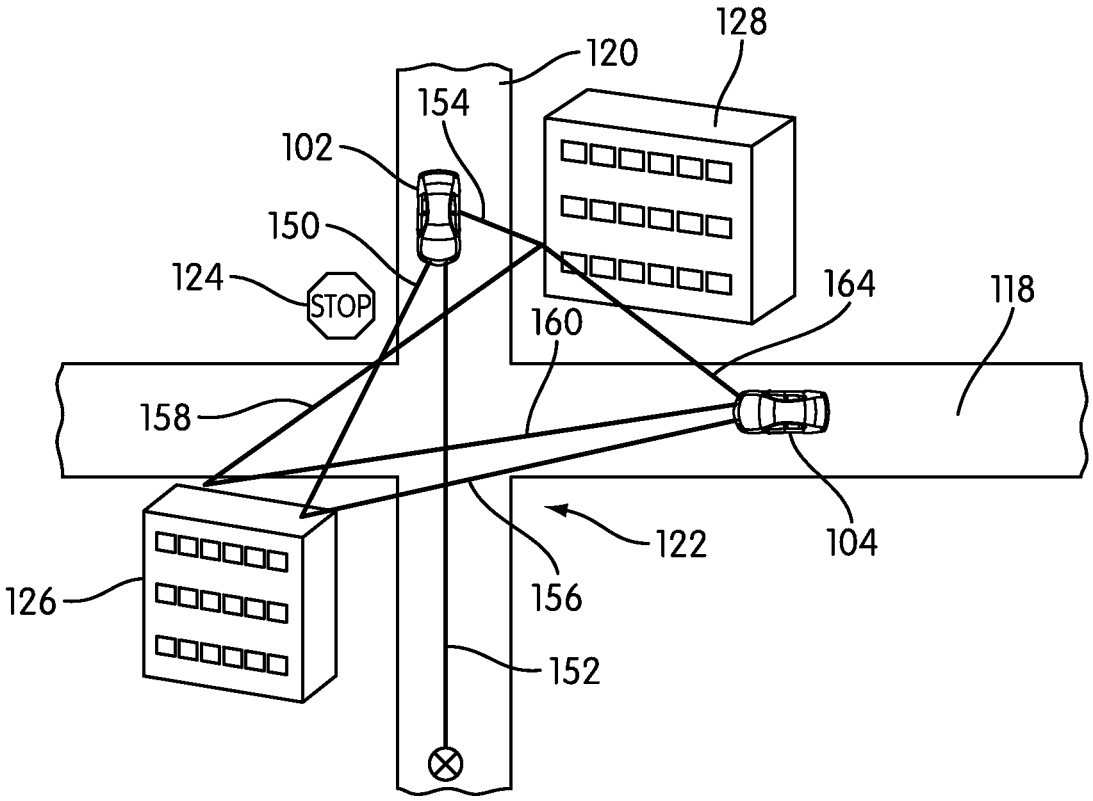
FIG. 7 is a schematic drawing showing an embodiment of a DSRC-based collision avoidance system operating at full power when slowing to yield to a traffic signal in an intersection.

FIGS. 6-7 show how the CAS power boost as described above may assist in preventing collisions at an intersection such as intersection 122. As shown in FIG. 6, one or more signals 150, 152, 154 are transmitted by first vehicle 102 when operating at low power. Using the situation as described above with respect to FIG. 2, vehicle 102 is approaching traffic control device 124 but the power level has not been boosted. In other words, vehicle 102 is still operating at low power as it begins to approach intersection 122.

These signals may not be able to reach second vehicle 104 for direct vehicle-to-vehicle communications. Although only three signals are shown for the sake of simplifying the discussion, the signals would generally travel away from vehicle 102 in all directions. A first signal 150 may reach first building 126 and reflect a short distance, but does not reach second vehicle 104. A second signal 152 simply fades out while traveling straight along first roadway 120, and a third signal 154 is blocked and scattered by second building 128. At this point, first vehicle 102 cannot detect second vehicle 104 using the CAS, and second vehicle 104 cannot detect first vehicle 102 using the CAS.

In FIG. 7, first vehicle 102 has slowed when approaching traffic control device 124, a stop sign. According to an embodiment of the power management procedure of the invention, the power to the CAS system of first vehicle 102 has been increased, such as to full power. The signal strength of the transmissions from the CAS of first vehicle 102 have also been increased. This signal strength increase allows the signals to take advantage of the geometry of the obstructions to diffract and reflect off of those obstructions to reach second vehicle 104.

For example, first signal 150 reflects or bounces off of first building 126 to become first reflected signal 156. First reflected signal 156 is oriented to reach and has sufficient signal strength to reach second vehicle 104. Second signal 152 is stronger, but still misses second vehicle 104 due to a lack of an obstruction or structure off of which is can reflect or diffract. Third signal 154 reflects off of second building 128 to become second reflected signal 158. Second reflected signal 158 reflects off of first building 126 to become third reflected signal 160. Third reflected signal 160 is oriented to reach and has sufficient signal strength to reach second vehicle 104. Additionally, as first signal 154 hits second building 128, the signals scattering and reflecting of the signal off of second building 128 interfere with the original signal 154. This interference may result in diffracting first signal 154, i.e., "bending" first signal 154 around second building 128, to form diffracted signal 164. Though typically lower in signal strength than reflected signals, diffracted signal 164 may still posses sufficient signal strength to reach second vehicle 104. Using these reflected and refracted signals, an vehicle-to-vehicle communications link, such as vehicle-to-vehicle communications link 112 shown in FIG. 2, may be established. Similarly, though not shown in FIGS. 4 and 5 for clarity, reflection and diffraction of boosted power signals may assist in establishing a system communications link between first vehicle 102 and an RSE, such as system communications link 114 as shown in FIG. 2.

These mechanisms by which the signals take advantage of the geometry of the surrounding environment to establish communications links between first vehicle 102 and second vehicle 104 are examples. Any signal may be redirected using reflection, diffraction, or even atmospheric refraction.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the invention.

What is claimed is:

1. A method for operating a collision avoidance system of a first vehicle that utilizes a short to medium range communications within a a short to medium range communication system, the method comprising the steps of:

operating the collision avoidance system at a first system power level within the a short to medium range communication system under low collision risk conditions;

wherein the step of operating the collision avoidance system at the first system power level comprises transmitting a signal with the at a first transmission power level from the first vehicle that is configured to be received at a second vehicle to establish a vehicle-to vehicle communication link;

determining if the first vehicle is approaching a location of increased collision risk, wherein the increased collision risk location comprises at least one of a traffic control device and a non-line of sight intersection;

increasing the first system power level to a second system power level within the a short to medium range communication system when the first vehicle is approaching the location of increased collision risk, wherein the second system power level is greater than the first system power level;

transmitting a signal with the at a second transmission power level from the first vehicle that is configured to be received at the second vehicle to establish a vehicle-to vehicle communication link, wherein the second transmission power level is greater than the first transmission power level;

decreasing the second system power level back to the first system power level within the a short to medium range communication system when the first vehicle has passed through the location of increased collision risk;

receiving communications within the a short to medium range communication system using a single antenna under low collision risk conditions;

determining if the first vehicle is approaching a location of increased collision risk; and receiving communications within the short to medium range communication system using an antenna diversity technique when the first vehicle is approaching the location of increased collision risk.

2. The method of claim 1, further comprising the step of providing navigation information to the collision avoidance system from a navigation system that is in communication with the collision avoidance system.

3. The method of claim 2, wherein the navigation information is used to determine that the first vehicle is approaching the location of increased collision risk.

4. The method of claim 3, wherein the navigation information includes a database that includes known locations with the presence of a traffic control device.

5. The method of claim 3, wherein the navigation information includes the location of the first vehicle.

6. The method of claim 1, wherein a deceleration of the vehicle indicates that the first vehicle is approaching the location of increased collision risk.

7. The method of claim 1, wherein the collision avoidance system utilizes vehicle-to-vehicle communications.

8. A method for operating a collision avoidance system of a first vehicle that utilizes short to medium range communications within a short to medium range communication system, wherein the collision avoidance system has more than one antenna, the method comprising the steps of:

receiving communications within the short to medium range communication system at the first vehicle using a single antenna under low collision risk conditions;

determining if the first vehicle is approaching a location of increased collision risk, wherein the increased collision risk location comprises at least one of a traffic control device and a non-line of sight intersection; receiving communications within the short to medium range communication system at the first vehicle using an antenna diversity technique when the first vehicle is approaching the location of increased collision risk; and receiving communications within the short to medium range communication system at the first vehicle using a signal antenna when the first vehicle has passed through the location of increased collision risk.

9. The method according to claim 8, wherein the antenna diversity technique is selected from the group consisting of switching, selecting, combining, dynamic control, and combinations of these tecniques.

10. The method according to claim 8, wherein the location of increased collision risk comprises an area proximate the traffic control device.

11. The method of claim 8, further comprising periodically compairing a position of the first vehicle with known locations of non-line of sight intersections to determine the increased risk location.

* * * * *